US005680844A

United States Patent [19]

Felton et al.

[11] Patent Number: 5,680,844

[45] Date of Patent: Oct. 28, 1997

[54] FUEL PUMP

[75] Inventors: George Nicholas Felton; Michael Peter Cooke, both of Kent, England

[73] Assignee: Lucas Industries public Limited Company, West Midlands, England

[21] Appl. No.: 571,555

[22] Filed: Dec. 13, 1995

Related U.S. Application Data

[63] Continuation of Ser. No. 288,396, Aug. 10, 1994, abandoned.

[30] Foreign Application Priority Data

Aug. 24, 1993 [GB] United Kingdom ..... 9317615

[51] Int. Cl.[6] ..... F02M 37/04

[52] U.S. Cl. ..... 123/450; 123/198 DB; 417/462

[58] Field of Search ..... 123/198 DB, 198 D, 123/450, 506, 510; 417/462, 283

[56] References Cited

U.S. PATENT DOCUMENTS

| | | | |
|---|---|---|---|
| 4,601,274 | 7/1986 | Seilly | 123/450 |
| 4,625,694 | 12/1986 | Adey | 123/450 |
| 4,691,679 | 9/1987 | Lakin | 123/450 |
| 4,696,271 | 9/1987 | LeBlanc | 123/450 |
| 4,920,940 | 5/1990 | Harris | 123/450 |
| 5,027,776 | 7/1991 | Nicol | 123/450 |
| 5,207,202 | 5/1993 | Collingborn | 123/450 |

*Primary Examiner*—Carl S. Miller

*Attorney, Agent, or Firm*—Cesari and McKenna

[57] ABSTRACT

A rotary distributor fuel injection pump includes a pumping plunger housed in a bore and has a spill valve member integrally formed with an actuator piston contained in a cylinder. High pressure fuel from the bore can be admitted to the one end of the cylinder to move the actuator piston and valve member away from the seating by opening an on/off valve. When the spilled fuel has been returned to the bore further fuel flows to the bore by way of the on/off valve and this fuel flows to the on/off valve through a non-return valve from a source of fuel under pressure.

3 Claims, 2 Drawing Sheets

FUEL PUMP

This is a continuation of Ser. No. 08/288,396 filed Aug. 10, 1994, now abandoned.

This invention relates to a fuel pumping apparatus for supplying fuel to a multi-cylinder compression ignition engine and of the kind comprising a rotary distributor member housed in body, a pumping plunger slidable within a bore, a delivery channel formed in the distributor member, the delivery channel communicating with said bore and being positioned to register in turn with a plurality of outlet ports formed in the body during successive inward movements of the pumping plunger, cam means for imparting inward movement to the plunger to displace fuel from the bore through said delivery channel, a spill valve member which is spring biased into engagement with a seating, said spill valve member when lifted from the seating during inward movement of the plunger allowing fuel to spill from the bore, an actuator piston for said valve member said actuator piston being located in a cylinder to one end of which fluid under pressure can be supplied under the control of a valve means, and a source of fuel from which fuel can be supplied to said bore.

In the known form of apparatus of the aforesaid type the fuel is supplied to the bore by way of a port in the body and passages in the distributor member and a passage moves into register with the port during the time when the plunger is allowed to move outwardly by the cam means. During the period when the plunger can move outwardly the spill valve also has to return into engagement with the seating and in arranging the size and spacing of the ports and passages provision has to be made to allow the timing of fuel to be varied. The result is that there may not be adequate time available to complete the filling of the bore.

The object of the invention is to provide an apparatus of the kind specified in an improved form.

According to the invention in an apparatus of the kind specified said valve means comprises an on/off valve which is positioned in a passage connecting said one end of the cylinder with said bore, and a non-return valve is provided which connects a point intermediate said on/off valve and said one end of the cylinder, with said source of fuel.

An example of a fuel pumping apparatus in accordance with the invention will now be described with reference to the accompanying drawings in which.

Figure 1:
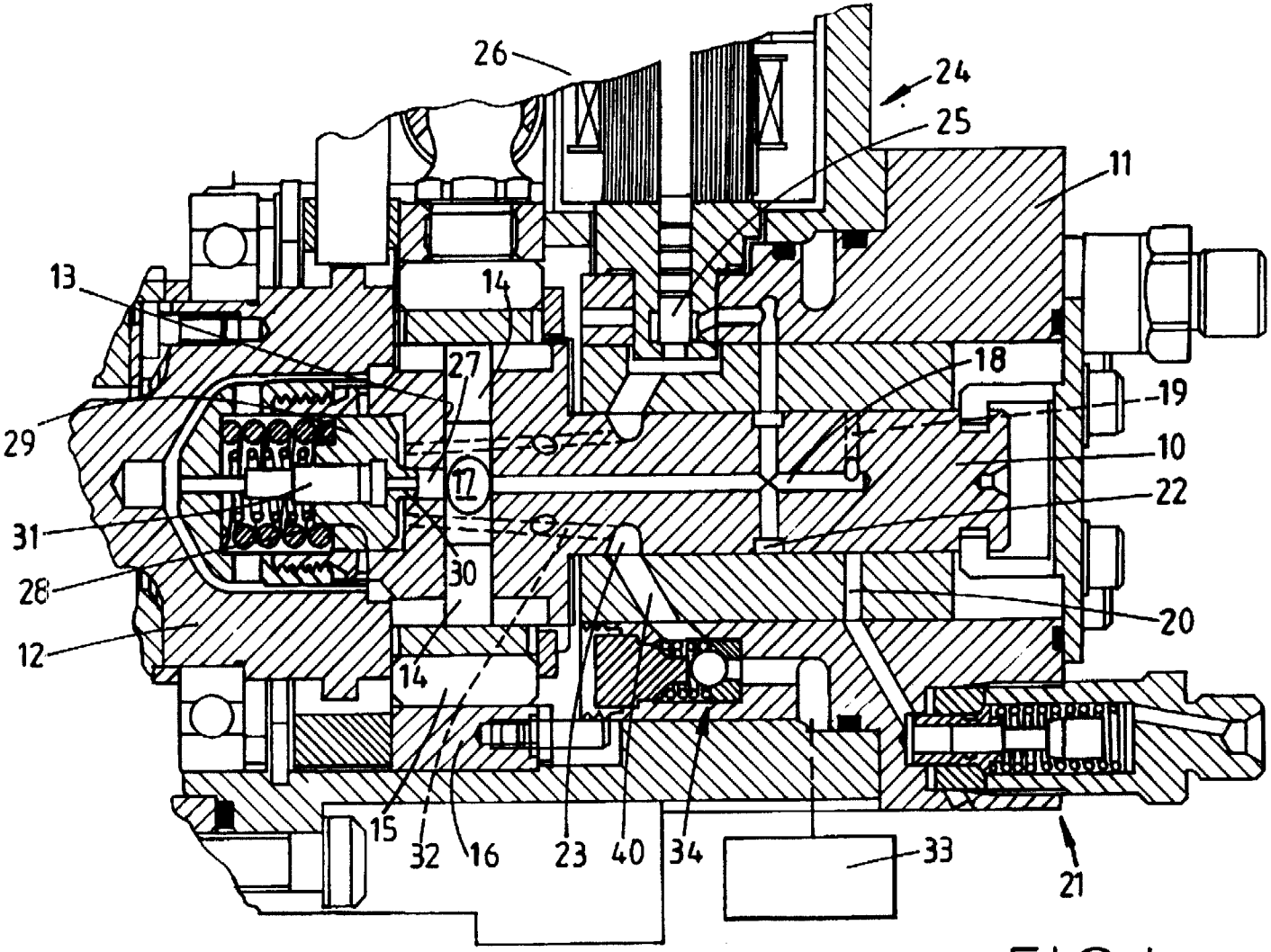
FIG. 1 is a sectional side elevation of part of the apparatus.

Referring to FIG. 1 of the drawings the apparatus comprises a rotary distributor member 10 which is mounted for rotation in a pump body 11 and which is coupled to a drive shaft 12 which in use, is driven in timed relationship with the associated engine.

Formed in the distributor member is a pair of transversely extending bores 13 which are disposed in the same plane and at right angles to each other. Each bore accommodates a pair of pumping plungers 14 which engage at their outer ends, with cam followers which incorporate rollers 15 engageable with the internal peripheral surface of an annular cam ring 16. At their inner ends the plungers define a pumping chamber 17 which communicates with a longitudinal bore 18 which communicates with an outwardly extending delivery passage 19. The delivery passage is positioned to register in turn with a plurality of outlet ports 20 which are formed in the body and which connect with outlets 21 respectively each outlet housing a delivery valve.

The outlets in use, are connected to the injection nozzles respectively of the associated engine.

The passage 18 by way of a plurality of passages communicates with a circumferential groove 22 formed on the periphery of the distributor member.

Also formed on the distributor member is a further circumferential groove 23 and these grooves can be connected together through an on/off valve generally indicated at 24 and which includes a valve member 25 moveable to the closed position by an electromagnetic actuator 26.

Also communicating with the pumping chamber is a spill passage 27 which opens into a cylinder 28 formed in an extension of the distributor member housed within a recess in the drive shaft 12. Slidable within the cylinder is an actuator piston 29 which carries a valve member 30 for engagement with a seating which is defined about the spill passage 27. The piston is biased by means of in the example, a pair of springs so that the valve member is urged into engagement with the seating and the springs are located between the piston and a hollow cap which is in screw thread engagement with the extension. The actuator piston is provided with a central bore which has a diameter slightly larger than the seating area of the valve member and the inner end of the bore is in constant communication with the spill passage 27. Mounted in the bore is a plunger 31 which is engageable with the aforesaid cap.

The inner end of the cylinder is connected by means of passages 32 to the circumferential groove 23.

Also provided is a source 33 of fuel under pressure and conveniently this is in the form of a pump the rotary part of which is carried on a portion of the drive shaft. The output pressure of the pump is controlled by a suitable control valve not shown.

Figure 2:
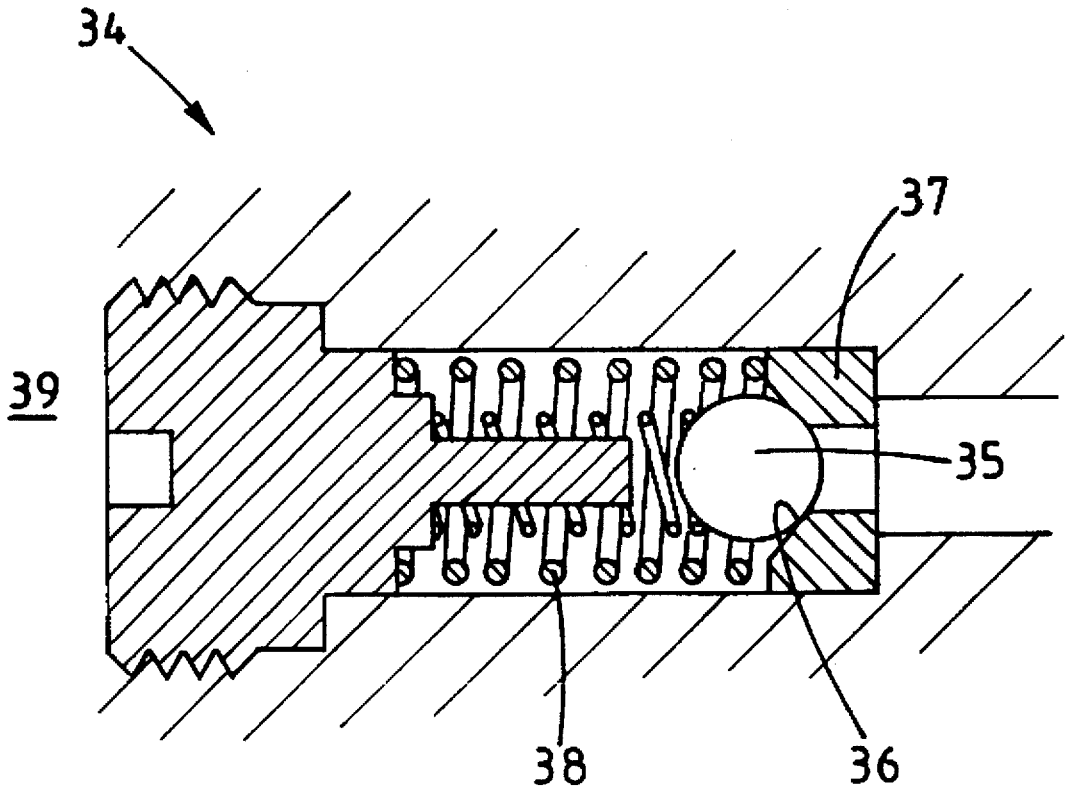
FIG. 2 is a view to an enlarged scale of part of the apparatus seen in FIG. 1.

The outlet of the pump is connected to the circumferential groove 23 by way of a non-return valve 34 an example of which is shown in greater detail in FIG. 2. The valve comprises a ball 35 which is spring biased into engagement with a seating 36, the seating being defined on an annular part 37 which is held in engagement with a step defined in a bore in the body 11, by means of a spring 38. The spring 38 and the spring which biases the ball into engagement with the seating are located by means of a plug 39 and a passage 40 connects the spring chamber of the valve with the circumferential groove 23.

In operation, and starting from the position in which the parts are shown in the drawing, the filling of the various passages within the distributor member has been completed and as the distributor member rotates, the delivery passage 19 will move into register with an outlet port 20 and the plungers will start to move inwardly. The valve 24 is closed and so all the fuel displaced from the pumping chamber is supplied to the associated engine through an outlet 21. If during the inward movement of the plungers the valve 24 is opened fuel from the pumping chamber can flow from the groove 22 to the groove 23 and to the inner end of the cylinder 28, the valve 34 preventing flow of fuel to the source 33. The flow of fuel into the cylinder causes displacement of the actuator piston 29 against the action of its springs so that the valve member 30 is lifted from its seating. This allows fuel to escape through the spill passage 27 into the cylinder and results in a lowering of the pressure in the pumping chamber and a reduction of pressure at the outlet port. The valve member in the associated injection nozzle closes and no more fuel is fed to the engine. Fuel will continue to be displaced from the pumping chamber as the plungers move inwardly and this will simply result in further movement of the actuator piston against the action of its springs. When the rollers roll over the crests of the cam lobes the springs biasing the actuator piston urge the piston back towards the one end of the cylinder and in so doing fuel is returned to the pumping chamber thereby causing outward movement of the plungers.

The flow of fuel from the one end of the cylinder can take place directly through the spill passage 27 to the bores and through the passages 32 and via the valve 24 to the bores. When the valve member 30 engages the seating then apart from the fuel which has been lost by leakage, all the fuel spilled in the previous inward stroke of the plungers has been returned to the pumping chamber 17. The valve 34 then opens to permit fuel to flow from the source by way of the valve 24 into the pumping chamber so that the plungers are moved outwardly their maximum extent. When the plungers have moved outwardly their maximum extent the valve 34 closes and the cycle is repeated. It is intended that the valve 24 should be closed prior to inward movement of the plungers taking place and therefore the timing of the start of delivery of fuel depends upon the angular setting of the cam ring 16. The angular setting is therefore adjustable conveniently by means of a fuel pressure actuator piston, in order to vary the timing of the commencement of delivery of fuel.

The action of the plunger 31 is merely to effect pressure balancing of the valve member 30 when it is in the closed position since owing to the slightly larger diameter of the bore in which the plunger is mounted, there will be a force acting on the valve member to maintain it in contact with the seating, due to the pressure of fuel in the pumping chamber.

It will be appreciated that the non-return valve 34 is protected from the very high pressure which is developed during actual delivery of fuel to the associated engine, by the fact that the valve 24 is closed. Moreover, the period available to fill the bores 13 with fuel is unaffected by the angular setting of the cam ring 16.

We claim:

1. A fuel pumping apparatus for supplying fuel to a multi-cylinder compression ignition engine, comprising a rotary distributor member housed in a body, a pumping plunger slidable within a bore, a delivery channel formed in the distributor member, the delivery channel communicating with said bore and being positioned to register in turn with a plurality of outlet ports formed in the body during successive inward movements of the pumping plunger, cam means for imparting inward movement to the plunger to displace fuel from the bore through said delivery channel, a spill valve member spring biased into engagement with a seating, said spill valve member when lifted from the seating during inward movement of the plunger allowing fuel to escape from the bore, an actuator piston for said valve member said actuator piston being located in a cylinder to one end of which fluid under pressure can be supplied to said bore, said valve means comprising an on/off valve which is positioned in a passage providing a permanent connection between said one end of the cylinder and said bore and a non-return valve which connects a point intermediate said on/off valve and said one end of the cylinder, with said source of fuel whereby when the plunger is allowed to move outwardly and the on/off valve is open, fuel can flow through the non-return valve and the on/off valve to the bore.

2. An apparatus according to claim 1, in which said non-return valve is a spring loaded ball valve.

3. An apparatus according to claim 1 or claim 2, in which the actuator piston and the valve member are integrally formed with each other and the action of the spring is to displace the spilled fuel in the one end of the cylinder to the bore by way of the spill passage and the on/off valve.

* * * * *